United States Patent [19]

Pust

[11] Patent Number: 4,694,602

[45] Date of Patent: Sep. 22, 1987

[54] REVOLVER HANDGUN

[76] Inventor: Klaus O. M. Pust, 935 Ashton St., Jacksonville, Fla. 32208

[21] Appl. No.: 875,069

[22] Filed: Jun. 17, 1986

[51] Int. Cl.[4] ..... F41C 1/00; F41C 1/02

[52] U.S. Cl. ..... 42/59; 42/64; 42/68

[58] Field of Search ..... 42/59, 63, 64, 68

[56] References Cited

U.S. PATENT DOCUMENTS

| | | | |
|---|---|---|---|
| 221,000 | 10/1879 | Smith | 42/68 |
| 530,759 | 12/1894 | Foehl | 42/63 |
| 688,217 | 12/1901 | Whiting | 42/59 |
| 1,077,135 | 10/1913 | Guerrero | 42/59 |
| 2,835,171 | 5/1958 | Lyon | 42/59 |
| 3,729,853 | 5/1973 | Critcher | 42/59 |

FOREIGN PATENT DOCUMENTS

| | | | |
|---|---|---|---|
| 2917257 | 4/1980 | Fed. Rep. of Germany | 42/59 |
| 12367 | of 1898 | United Kingdom | 42/59 |

*Primary Examiner*—Deborah L. Kyle
*Assistant Examiner*—Michael J. Carone
*Attorney, Agent, or Firm*—Arthur G. Yeager

[57] ABSTRACT

A simplified revolver handgun comprises an interacting trigger and hammer mechanism which in their normal movements cause a transfer rod to move linearly inside the extractor assembly of the cylinder, the transfer rod having on its outside surface a network of grooves which mate with an inwardly directed protrusion in the bore of the extractor assembly, the network being a repeating series of cam action sections, each section including a location for firing when said hammer and a cartridge are aligned, and a location when the hammer rests in close proximity to the cylinder but between adjacent cartridges in a nonfiring position. Other optional features include (1) placing warnings of the dangers of a handgun on the outside of the cylinder and/or the handle; (2) providing a removable hammer nose to render the handgun safe when not in use; (3) a transparent inspection shield for viewing the bases of cartridges in the cylinder; (4) a means for moving the cylinder forward against the barrel to effect a gas seal during firing; (5) a means for using explosion gases to rotate the cylinder, cock the hammer, and eject spent shells from the cylinder; and (6) a revolver with a totally enclosed cylinder.

8 Claims, 34 Drawing Figures

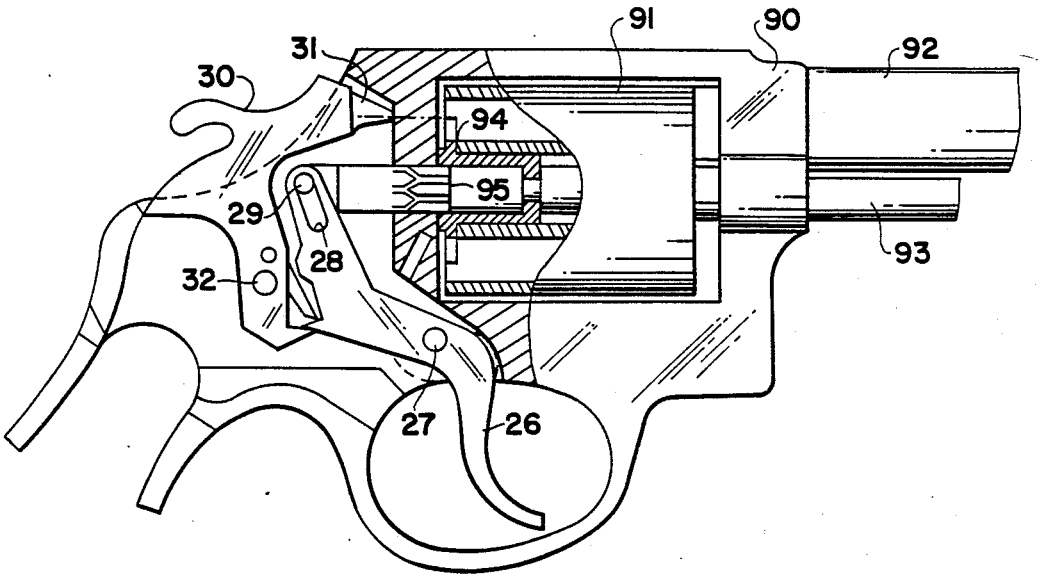
FIG 1
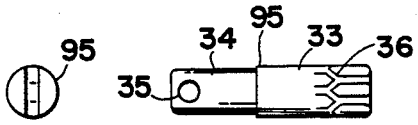
FIG 3
FIG 2
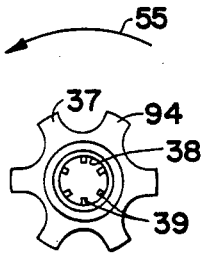
FIG 4
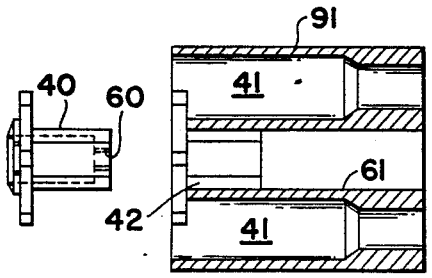
FIG 5
FIG 7
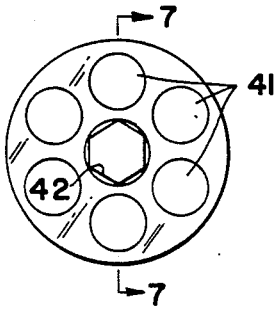
FIG 6

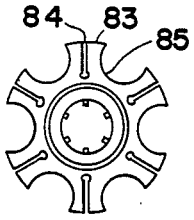
FIG 26
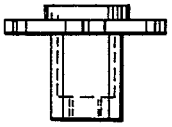
FIG 27
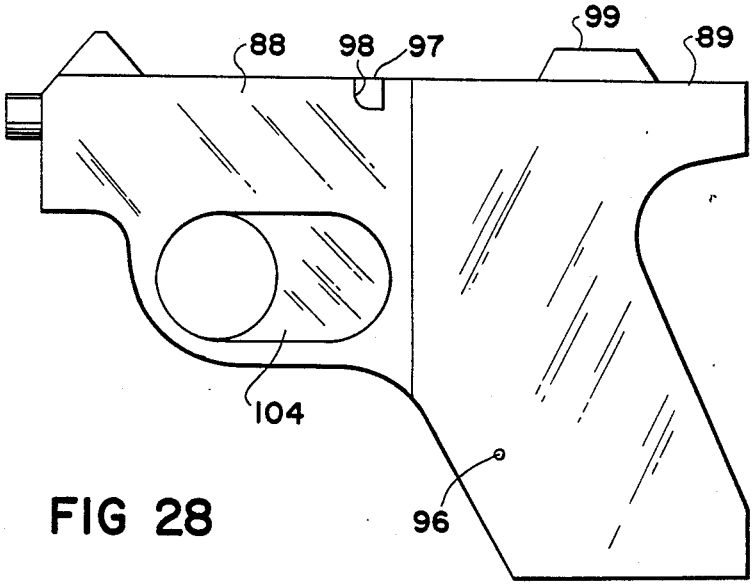
FIG 28
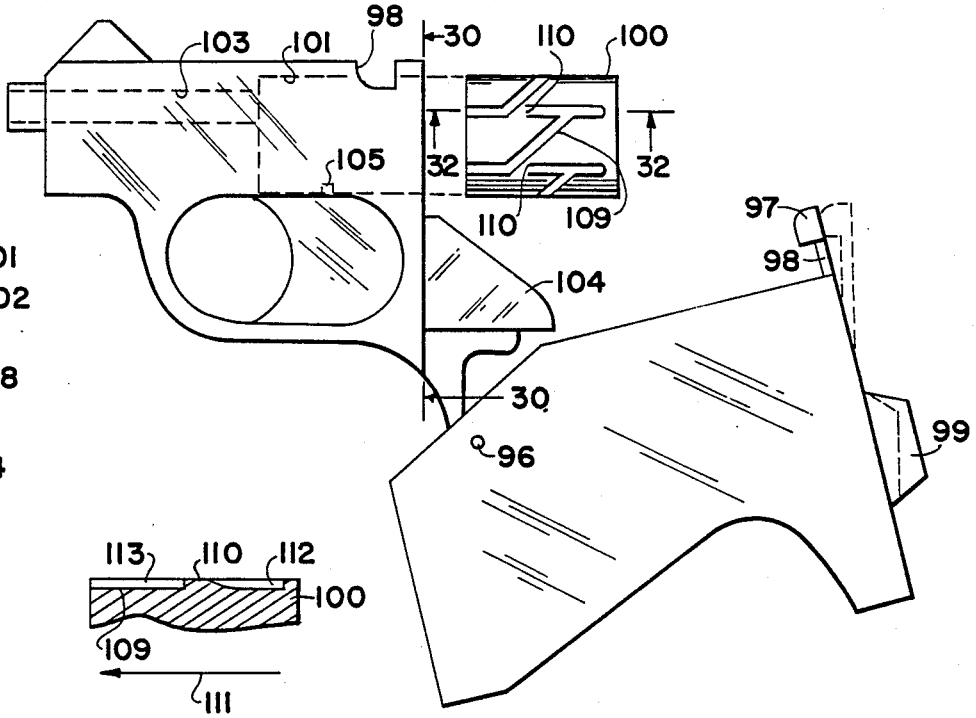
FIG 29
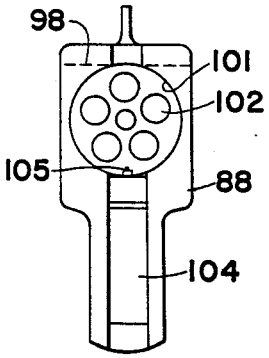
FIG 30
FIG 32
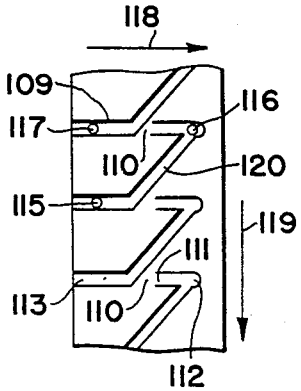
FIG 31
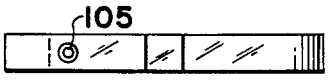
FIG 33
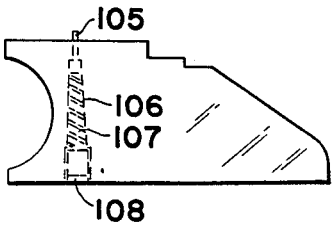
FIG 34

REVOLVER HANDGUN

BACKGROUND OF THE INVENTION

Revolver handguns have changed very little in their operating mechanisms for about 100 years. Each gun includes about 60 different parts, some of which, such as pins and screws, are used in more than one location making the total number of parts to be greater than 60. While these pieces have been refined over the years so as to function well in the handgun, they necessarily provide many possibilities for breakage and malfunctioning. More recent designs of other types of firearms have simplified the mechanisms by eliminating several parts.

It is an object of this invention to provide a novel revolver handgun with many fewer operating parts. It is another object of this invention to provide a safer revolver handgun. It is another object of this invention to provide a novel system for rotating the cylinder of a revolver. It is another object to provide a revolver handgun that can be manufactured without the necessity for hand finishing each gun to make it operate smoothly. Still other objects will become apparent from the more detailed description which follows.

BRIEF SUMMARY OF THE INVENTION

This invention relates to a revolver handgun having a revolving cylinder with a trigger and hammer mechanism that causes the cylinder to rotate when the trigger or hammer is moved, wherein said mechanism includes a transfer rod linearly slidably mounted in the bore of an extractor assembly having a star-shaped head and a tubular shaft, said rod being connected to said trigger and hammer assembly to move linearly in said bore by pulling of said trigger or operating of said hammer; said rod having a network of grooves on its surface to mate with a protrusion directed radially inward from the surface of said bore whereby linear movement of said rod causes progressive radial rotation of said extractor assembly, said shaft of said extractor assembly being mounted in a central bore in said cylinder by means permitting relative linear movement but no relative rotational movement, said network of grooves providing a continuous pathway of repeating cam sections around the outside surface of said transfer rod, each repeating cam section having a first location where said trigger and hammer are in their normal positions after firing, and a second location where said cartridge primer and said hammer are aligned in firing position.

In preferred embodiments the cylinder and hammer are aligned between cartridge chambers when the trigger is released after firing, and transport rod engages 1-6 protrusions in the extractor assembly which, in turn, is keyed to the cylinder bore so that linear movement of the transport rod produces rotational movement of the cylinder. Other preferred features include (1) advertisements or warnings of danger of gun stamped on cylinder and/or handle; (2) a manually removable hammer nose to enhance safety of gun; (3) an inspection shield for viewing the bases of the cartridges in the cylinder to see which are spent; (4) means for sealing the cylinder to the barrel to prevent expulsion of gases when firing; (5) means for using the force of the explosion gases to rotate the cylinder, cock the hammer, and to eject spent cartridge casings from the cylinder, and (6) a novel design for a revolver in which the cylinder is totally enclosed.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 1 is a side elevational view partially in cross section of a revolver handgun of this invention;

FIG. 2 is a side elevational view of the transport rod;

FIG. 3 is a front elevational view of the transport rod;

FIG. 4 is a front elevational view of an extractor assembly for use with standard cartridges;

FIG. 5 is a side elevational view of the extractor assembly of FIG. 4;

FIG. 6 is a top plan view of the cylinder;

FIG. 7 is a cross sectional view taken at 7—7 of FIG. 6;

FIG. 26 is a front elevational view of an extractor assembly for use with rimless cartridges;

FIG. 27 is a side elevational view of the extractor assembly of FIG. 26;

FIG. 28 is a side elevational view of an enclosed cylinder revolver;

FIG. 29 is a side elevational view of the revolver of FIG. 28 broken open to show removal of the cylinder;

FIG. 30 is a rear elevational view taken at 30—30 of FIG. 29;

FIG. 31 is a layout of the surface of the cylinder of the revolver of FIGS. 28-30;

FIG. 32 is a cross sectional view taken at 32—32 of FIG. 29;

FIG. 33 is a top plan view of the trigger of the revolver of FIGS. 28–30; and

FIG. 34 is a side elevational view of the trigger of FIG. 33.

DETAILED DESCRIPTION OF THE INVENTION

Figure 8:
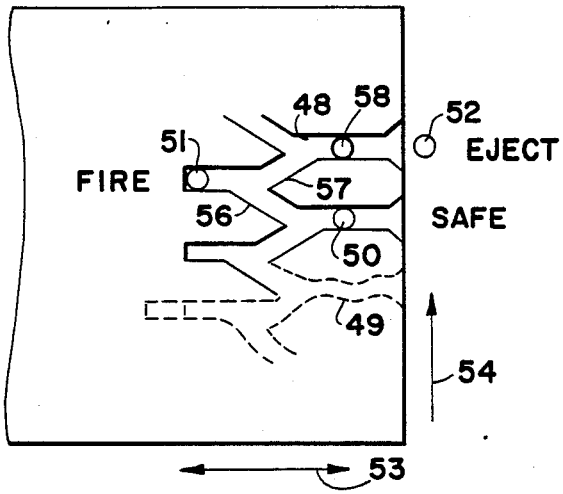
FIG. 8 is a layout of the surface of the transport rod.
Figure 11:
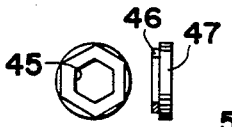
FIG. 11 is a top plan view of the hex-hex washer.
Figures 9, 12:
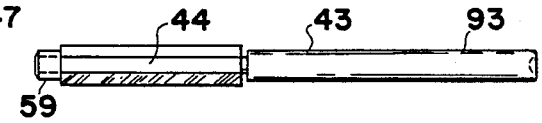
FIG. 9 is a side elevational view of the extractor rod.
FIG. 12 is a side elevational view of the hex-hex washer.
Figure 10:
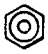
FIG. 10 is a top plan view of the extractor rod.

In FIG. 1 of the attached drawings there is an illustration that shows the principal feature of this invention. The revolver handgun of this invention comprises a simplification of the internal mechanism of any of the standard well known guns of today, such as Colt, Smith and Wesson, and the like. The simplification is in the mechanism which turns the cylinder when the trigger is pulled or the hammer is cocked in the operation of firing the gun. Generally, all other parts of the revolver are standard.

Gun frame 90 houses cylinder 91 and has attached thereto the barrel 92. Underneath barrel 92 is the extractor rod 93, which, when cylinder 91 is released and is pivoted away from alignment with barrel 92, is pushed toward cylinder 91 to cause all cartridges to be ejected from their respective chambers. Trigger 26 pivots around pin 27 to fire the gun when pulled to the rear. Hammer 30 pivots around pin 32 and carries hammer nose 31 which strikes the primer of a cartridge to fire the bullet.

The principal feature of the revolver of this invention is that a transfer rod 95 is employed to move linearly and reciprocally in the central bore in extractor assembly 94 to cause cylinder 91 to rotate. In modern revolvers the cylinder is rotated by means of several levers and springs in a ratchet action functioning on the outside of the cylinder. The linear movement of transfer rod 95 is accomplished by engagement of pin 29 in a slot 28 in trigger 26. When trigger 26 is pulled to the rear or when hammer 30 is pulled back to cock it preparatory to firing, transfer rod 25 moves forward. After firing an internal rebound spring moves trigger 26 forward causing transfer rod 95 to move linearly to the rear, ready for the next pulling of trigger 26 or cocking of hammer 30 to repeat the cycle.

In FIGS. 2–5 there are shown the details of transfer rod 95 and extractor assembly 94, which will make it clear how these two parts work together. Transfer rod 95 has a cylindrical cam section 33 having a network 36 of grooves around its outer surface at the forward end thereof. Shank portion 34 of transfer rod 95 is a flat section with a transverse hole 35 to receive pivot pin 29 that moves in slot 28. Network 36 of grooves engages one or more protrusions 39 directed inwardly from bore 38 in the shank 40 of extractor assembly 94. In the embodiment where the remainder of the handgun is unchanged from that which is known today the notches between fingers in extractor star 37 fit under the flanges at the base of cartridges causing them to be ejected from cylinder 91 when extractor rod 93 is pushed toward the rear with cylinder 91 rotated outside of the frame of the revolver. In the case where rimless cartridges (such as used in automatic handguns) are used in revolvers the extractor assembly is designed differently as shown in FIGS. 26–27 so as to provide a spring action to grip the cartridges. Each point 83 of the extractor star is split with a slot which permits notches 85 to spread apart sufficiently to grip the base of a rimless cartridge in a spring action. The remainder of the extractor assembly of FIGS. 26–27 is the same as that of FIGS. 4–5.

The general movement caused by protrusions 39 in network 36 can best be seen and understood in FIG. 8 which shows a flat layout of the network 36 of grooves on cam section 33 of transfer rod 95. The shaded portions of FIG. 8 show the lands while the unshaded portions are the grooves. Small circles in the grooves represent one of protrusions 39 (see FIG. 4) of the extractor assembly 94. The grooves may take the form of straight angled grooves 48 shown in solid lines or curved grooves 49 shown in dotted lines. Preferably the grooves are straight intersecting at angles with each other as at 48. The curved grooves are of special interest in providing a different "feel" to the trigger when it is fired. The functions of the straight grooves and curved grooves are, however, the same. In any event, the end result is a continuous undulating groove around the surface of transfer rod 95 which has as many repeating sections as there are cartridges in cylinder 91.

As the cam section 33 of transfer rod 95 is moved linearly (to the right or left on the drawing as shown by arrow 53) with protrusion 39 of extractor assembly 94 following the grooves, protrusion 39 and its extractor assembly 94 and cylinder 91 will move upward as shown by arrow 54, which is the same as a counterclockwise motion of extractor assembly 95 shown by arrow 55 in FIG. 4. If protrusion 39 is at 50 and transfer rod 95 is moved to the right, it causes protrusion 39 to bear against angled land 56 which moves protrusion 39 to position 51 in the direction of arrow 54 (counterclockwise in the direction of arrow 55 in FIG. 4). When transfer rod moves to the left while protrusion 39 is at position 51, protrusion 39 will contact angled land 57 and move up to position 58 (which is identical to position 50 for the next series of moves). The succeeding movement of transfer rod 95 to the right will begin the cycle all over again. It can therefore be appreciated that the lands and grooves in network 36 are several repeats of a single cam pattern for cocking and firing of the handgun. The number of cam patterns is the same as the number of cartridges in cylinder 91 (six patterns in the case of a "six-shooter"). The cam patterns extend exactly around the circumference of cam section 33 of transfer rod 95 to produce an unending continuous groove in which protrusion 39 travels. Generally, it is preferred to employ 3–6 protrusions 39 for a network 36 having six repeating cam patterns.

At position 50 and position 58 the hammer is forward, the trigger is forward and the hammer is aligned with a position half way between adjacent cartridges in cylinder 91. It is, therefore, a safe position where an accidental firing cannot occur because the hammer nose 31 is not able to contact a primer. At position 51 the gun is in the firing position (i.e., final movements of firing the gun), the trigger is pulled to the rear and the hammer has been released from its full rearward position and jumped forward by the action of a spring to cause the hammer nose 31 to strike the primer of a cartridge aligned therewith. Position 51 is substantially reached by pulling hammer 30 to the rear to its fully cocked position, where only a minute additional pull of trigger 26 will release hammer 30 to fire the gun. An additional position for protrusion 39 is shown at 52 where protrusion 39 is completely removed from engagement with network 36. This is reached by pushing forward on hammer 30 which in turn pulls transfer rod 95 to the rear and out of engagement with any groove in network 36. This releases cylinder 91 which may be pivoted laterally outside of the frame of the gun to permit access to cartridge chambers for ejection of cartridges or for loading of the chambers. When ejection or loading is completed, cylinder 91 may be swung back into alignment and transfer rod 95 will automatically engage its protrusion 39 into network 36 of grooves due to the bias of spring (not shown) which tends to keep transfer rod 95 engaged with protrusion 39 in the position 50 or 58.

Cylinder 91 is keyed to extractor assembly 94 by any convenient means. In these drawings there is shown a preferred means in which the outside of shank 40 of extractor assembly 94 is provided with a series of flat surfaces to mate with a similar series of flat surfaces in bore 42 of cylinder 91. A hexagonal cross section of shank 40 and of bore 42 is preferred since this shape is used frequently in other applications.

In FIGS. 9–12 are shown the remaining component parts for this mechanism of the revolver of this invention. Extractor rod 93 has a cylindrical handle portion 43 and a hexagonal sliding portion 44. The threaded tip 59 of extractor rod 93 is attached to tapped hole 60 in shank 40 of extractor assembly 94. A washer (FIGS. 11–12) having an inside hexagonal opening to slidingly mate over the outside of hexagonal section 44, a hexagonal boss 46 to mate with the inside of bore 42, and a circular body 47 to mate with the cylindrical bore 61 of cylinder 91 functions as a guide. The washer is press fitted into place at the junction of bore 42 and bore 61 and serves as a guide to bring shank portion 40 accurately back into mating relationship with bore 42 after extractor rod 93 is pushed to the rear to remove cartridges from cylinder 91.

Another embodiment of this invention is to employ the reverse of the above described locations of protrusions 39 and network 36 of grooves. Thus transfer rod 95 may have one or more protrusions 39 projecting outwardly from its surface with protrusions 39 engaging themselves in a network 36 of grooves machined on the bore 38 of extractor assembly 94. In such a system exactly the same rotating action of cylinder 91 occurs by linear movements of transfer rod 95 in extractor assembly 94.

Figure 13:
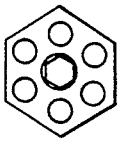
FIG. 13 is an end elevational view of a hexagonal cylinder.
Figure 14:
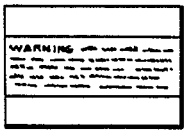
FIG. 14 is a side elevational view of a hexagonal cylinder.
Figure 15:
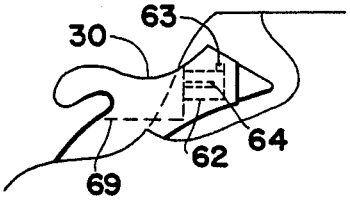
FIG. 15 is a side elevational view of the hammer with one type of safety lock.
Figure 16:
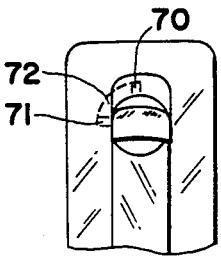
FIG. 16 is a rear elevational view of the hammer of FIG. 15.
Figure 17:
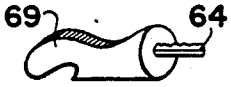
FIG. 17 is a perspective view of the thumb piece of FIG. 14.

It also is a feature of this invention to employ a cylinder 91 having a polygonal cross section, which results in a series of flat rectangular outside surfaces on cylinder 91. Such flat surfaces may then easily be stamped or etched with warnings as to safety measures in using the revolver or advertising material. FIGS. 13–14 illustrate this embodiment. Such warnings may also be placed on the handle of the gun in the form of raised lettering to provide a better grip.

Figure 20:
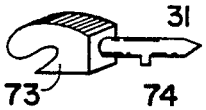
FIG. 20 is a perspective view of the thumb piece of FIG. 18.
Figure 18:
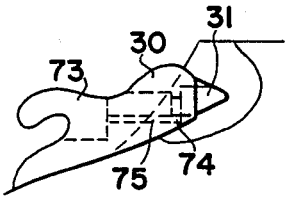
FIG. 18 is a side elevational view of the hammer with a second type of safety lock.
Figure 19:
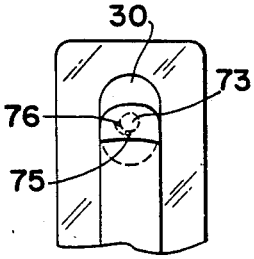
FIG. 19 is a rear elevational view of the hammer of FIG. 18.

In FIGS. 15–20 there are shown two versions of a novel safety feature of the revolver handgun of this invention. Hammer 30 has a lock 62 with a lug 63 which turns by means of a key 64 attached to removable thumb piece 69. Key 64 can be turned to move lug 63 from the firing position 70 to the safe locked position 71 where lug 63 is keyed into a grooved recess 72 in the frame of the gun. When in the locked position 71 with thumb piece 69 and key 64 removed, the gun cannot be fired nor can cartridges be inserted or removed from cylinder 91 because it cannot be pivoted outwardly until hammer 30 can be moved forward to place protrusion 39 in position 52 as described above. The version shown in FIGS. 18–20 is similar to that of FIGS. 15–17 in that a thumb piece 73 is removable from hammer 30. In this version, however, hammer nose 31 is removable with thumb piece 73 and locks into hammer 30 by means of a lug 74 engaging a keyway groove 75 in hammer 30. After being fully inserted, thumb piece 73 is rotated 90° and locked in place as at 76. To remove thumb piece 73 it is first rotated 90° and then pulled out of hammer 30. In this version the gun cannot be fired because there is no hammer nose 31 to strike a primer. However, cylinder 91 can be made to pivot away from the frame by pressing hammer 30 forward, and so this version is not as fully safe as that of FIGS. 15–17.

Figure 21:
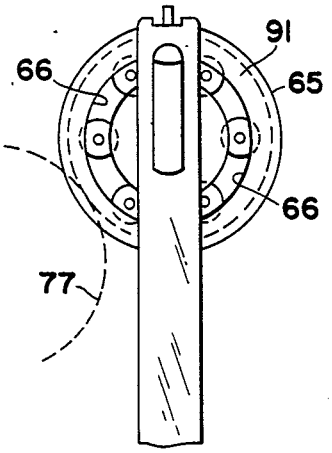
FIG. 21 is a rear elevational view of the inspection shield.
Figure 22:
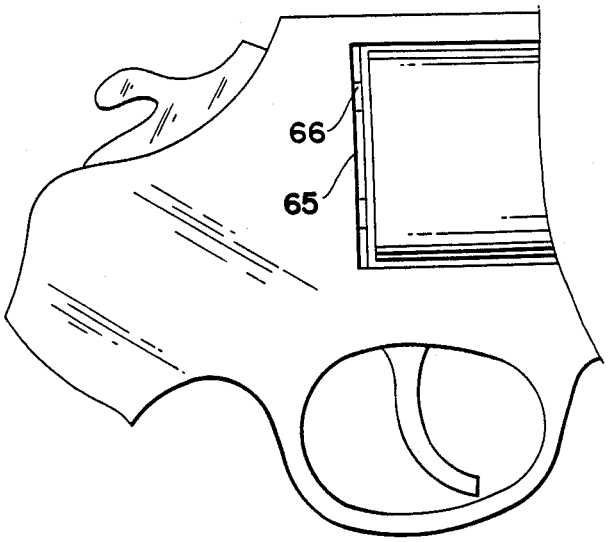
FIG. 22 is a side elevational view of the inspection shield.

Another safety feature is shown in FIGS. 21–22 as an inspection shield 65 which is placed immediately behind the rear of cylinder 91 where prior art revolvers have solid ears projecting laterally outward from the frame of the gun to protect against an accidental firing of a cartridge by a sharp object hitting a primer. Shield 65 is shown with two curved observation ports 66 each of which permits one to see the bases of three cartridges so that it can be determined, without swinging cylinder 91 away from its normal position, which are live and which are spent. All six cartridges can be seen because the transfer rod 95 engages protrusion 39 at position 50 (see FIG. 8) where hammer 30 is half way between adjacent cartridges in cylinder 91. Ports 66 are covered with a transparent glass or plastic which permits observation but does not permit a sharp pointed object to inadvertently strike a primer. Alternatively, the entire shield 65 may be made of a suitable glass or plastic which is transparent and is sufficiently tough not to be shattered or broken in normal use. Shield 65 is attached to the frame of the gun in an immovable position and with a central bore for transfer rod 25 to pass through without obstruction. Shield 65 is preferably sufficiently large in diameter that it serves as a stop to prevent cylinder 91 from falling off extractor rod 23 when cylinder 91 is pivoted out of the gun frame as at 77 to load or eject cartridges. This eliminates the necessity of having a frame lug now used on revolvers for this same purpose.

Figure 23:
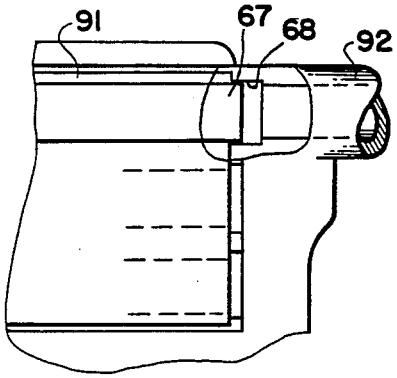
FIG. 23 is a side elevational view of the gas sealing embodiment.
Figure 24:
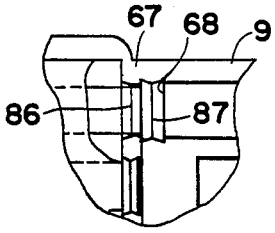
FIG. 24 is a partial side elevational view of an alternate gas sealing embodiment.
Figure 25:
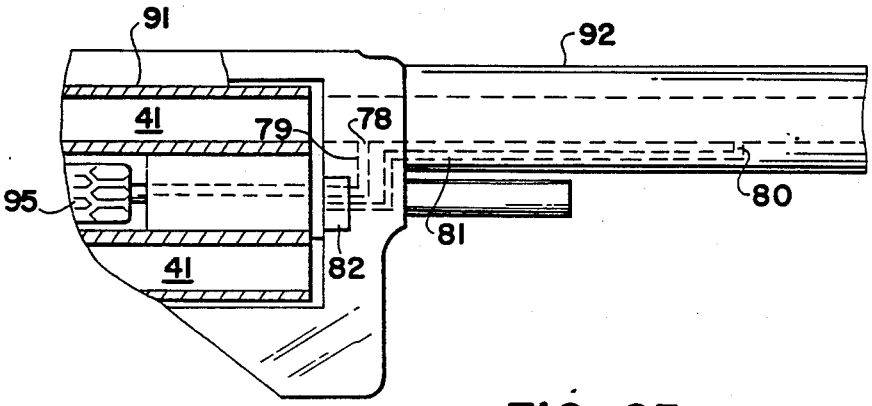
FIG. 25 is a side elevational view of the embodiment wherein explosion gases are employed to rotate the cylinder and eject the spent cartridge.

Another novel feature of this revolver is to provide a good gas seal between the forward surface of cylinder 91 and the rear surface of barrel 92 when the revolver is fired. Prior art guns provide close tolerances in this position so as to minimize any lateral gas pressure losses. In this invention as shown in FIG. 23 the mating surfaces of cylinder 91 and barrel 92 are cylindrically shaped with a male projection 67 preferably on cylinder 91 and the corresponding female recess 68 on barrel 92. It is to be understood, however, that this arrangement may be reversed with equivalent results such that the male projection is on barrel 92 and the female recess on cylinder 91. In order for the mating surfaces to be joined they must be able to be easily pushed together, but with a small tolerance (e.g., 0.001–0.005 inch) and the material of construction must have a sufficient elasticity to permit male projection 67 to expand slightly under the pressure of the explosion gases to make a tight fit momentarily, and then to contract immediately to allow projection 67 to be withdrawn easily from recess 68. The movement to insert projection 67 into recess 68 is produced by the forward movement of transfer rod 95 as the hammer reaches its fully cocked position immediately before firing. Upon firing, the release of the trigger permits a small rearward movement of transfer rod 95, which causes a small rearward movement of cylinder 91 sufficient to free male projection 67 from female recess 68 so cylinder 21 is free to rotate. Springs may be employed to assist in these movements of cylinder 91. FIG. 25 shows an alternate embodiment in which male projection 67 and female recess 68 are not cylindrical but are each formed of two frustoconical sections with the small ends abutting to form a ridge 86 in projection 67 and a corresponding ridge 87 in recess 68. This arrangement provides a better seal but is more difficult to manufacture.

In FIG. 25 there is shown a system for employing a portion of the explosion gases produced when firing the gun to eject a spent shell casing. When the bullet is propelled down the bore of barrel 92 there are high pressure gases behind the bullet. When the bullet passes port 78 some of the gases go into passageway 79 and exert pressure against the end of transfer rod 95 forcing it to the rear which causes cylinder 91 to rotate so that protrusion 39 is in position 50 (see FIG. 8). Meanwhile the bullet has proceeded out of the bore in barrel 92 and passed port 80 permitting the explosion gases to go into passageway 81 which is directed into the receiver 41 in cylinder 91 where the spent cartridge is located and there is sufficient gas pressure to blow the cartridge casing out of the receiver. This embodiment cannot of course be used unless there is no obstruction to the ejection of the shell casing. For example, inspection shield 65 (see FIGS. 21–22) must have an ejection notch cut into it. This feature is particularly adaptable to the use of rimless cartridges and the use of the extractor assembly of FIGS. 26–27. An offset housing 82 must be present to provide space for passageway 81 to be directed into receiver 41.

In FIGS. 28–34 there is shown a novel design for a revolver handgun wherein the cylinder is totally enclosed and is rotated by a modification of the system described above with respect to FIGS. 1–8. The revolver of this embodiment has a barrel section 88 and a handle section 89 connected pivotally to each other by pivot pin 96 so as to open to the position shown in FIG. 29. Latch 97 engages keyway 98 when barrel section 88 and handle section 89 are closed in the operating position shown in FIG. 28. Latch 97 is on one end of the latch sight bar 98 while rear sight 99 is on the other end of bar 98. A spring (not shown) urges latch into the position shown in FIG. 28 and the position shown in solid lines in FIG. 29. In order to open the gun, rear sight 99 is pressed downward to raise latch 97 to the position shown in dotted lines in FIG. 29. Cylinder 100 is seated in a cylindrical recess 101 in barrel section 88 and may be removed by opening the gun to the position shown in FIG. 29. Cylinder 100 rotates in recess 101 without the necessity of bearings, although such bearings may be included, if desired. Cartridge receivers 102 in cylinder 100 are aligned with barrel 103 when cylinder 100 is rotated to the aligned position. Trigger 104 is movable linearly forward and rearward in an appropriate keyway in barrel section 88. On the upper edge of trigger 104 is a retractable protrusion 105 held in a recess 106 by a spring 107 and a screw 108 which permits protrusion 105 to be retracted when pushed downward against the action of spring 107 which urges protrusion 105 to the position shown in FIG. 34. The outside surface of cylinder 100 contains a repeating network of grooves 109 which engage protrusion 105. As trigger 104 is moved linearly in firing the gun protrusion 105 rides in grooves 109 causing cylinder 100 to rotate from one aligned position to the next aligned position for firing cartridges. The network of grooves 109 is discontinuous at positions 110. Protrusion 105 passes over the discontinuous position 110 by being retracted and then protruding again when it reaches the next portion of groove 109. The general profile of grooves 109 is shown in FIG. 32 where the sloping part 111 causes protrusion 105 to withdraw as it moves in the direction of arrow 114 in traveling from groove portion 112 to groove portion 113. In FIG. 31 there is shown a flat layout of a portion of grooves 109 in the network on cylinder 100. In each repeating section of grooves 109 there are positions 115 and 116 where protrusion 105 is located at two moments during the firing of the gun. At position 115 the gun is at rest with trigger 104 in its normal position (see FIG. 28) with rebound spring (not shown) urging trigger 104 to its most forward position. As trigger 104 is pulled in the act of firing it moves protrusion 105 in the direction of arrow 118 which causes network of grooves 109 to move in the direction of arrow 119 which translates to a movement of cylinder 100 in the counterclockwise direction when viewed from the rear as in FIG. 30. Protrusion 105 follows the path of groove 120 as trigger 104 is pulled and protrusion 105 is at position 116 when the final movement of trigger 104 fires the gun. Upon release of trigger 104 after firing the rebound spring moves trigger 104 back to the position of rest (see FIG. 28) which causes protrusion 105 to move from position 116 to position 117 to begin a new cycle. This illustrates a variation in the system of using protrusions and grooves to rotate the cylinder. Here a retractable protrusion 105 permits grooves 109 to include a nongrooved portion 110, while the system described in connection with FIGS. 1–8 has a fixed protrusion 39 operating in a continuous groove 48, both systems accomplishing the same final result. The gun of FIGS. 28–34 is particularly desirable in employing a totally enclosed cylinder which avoids, therefore, nearly all possibilities for fouling the rotating mechanism due to dirt and other outside agents.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to be secured by Letters Patent is:

1. A revolver handgun having a revolving cylinder, a trigger and hammer mechanism that causes the cylinder to rotate when the hammer or trigger is moved, and an extractor assembly with a star shaped head, a central bore, and a shaft; said mechanism including a transfer rod having a transverse pin therein and being slidably mounted in said bore to move linearly therein when said trigger is pulled or said hammer is moved; said trigger having an upwardly extending member with a slot therein which engages said pin and is adapted to cause said rod to slide in said bore when said trigger or said hammer is moved; one of said rod and said bore having a network of grooves on its surface to mate with a plurality of radially directed protrusions on the surface of the other of said rod and said bore whereby linear movement of said rod causes progressive radial rotation of said extractor assembly, said shaft of said extractor assembly being mounted in a central bore in said cylinder by means permitting relative linear movement but no relative rotational movement, said network of grooves providing a pathway of repeating cam sections each having a first location where said trigger and hammer are in their normal positions after firing, and a second location where said cartridge primer and said hammer are aligned and said trigger and hammer are in firing position.

2. The revolver handgun of claim 1 wherein including means responsive to the movement of pulling said trigger for causing said transfer rod to penetrate deeper into said extractor assembly.

3. The revolver handgun of claim 1 wherein each said repeating cam section provides a location which forces the cylinder forward to contact a gas seal means at the rear of the barrel of said handgun to effect a gas seal for gases produced in firing a cartridge.

4. In a revolver handgun having a revolving cylinder aapted to contain a plurality of cartridges in an extractor assembly having a central bore and being keyed to the cylinder, a trigger mechanism and a hammer mechanism mechanically connected to said cylinder such that pulling of said trigger mechanism or cocking of said hammer mechanism causes said cylinder to rotate; the improvement wherein said handgun includes a transfer rod linearly and reciprocally slidable in said central bore by the forward or backward movement of the trigger and by the movement of cocking and release of the hammer, said rod having a continuous undulating groove around the outside surface thereof and said central bore having a protrusion extending radially inward and engaged in said groove; linear, reciprocal movements of said transfer rod causing rotational movement of said central bore, said rod having a transverse pin through its rear portion engaged with a slot in said trigger mechanism whereby pulling of said trigger causes said rod to move deeper into said central bore.

5. The handgun of claim 4 wherein said cylinder is hexagonal in the cross section taken perpendicular to its rotational axis.

6. The handgun of claim 4 wherein said continuous groove includes spaced positions where said protrusion may be separated fromm engagement with said groove when said cylinder is pivoted away from its firing alignment to fill or empty the cartridge receivers in said cylinder.

7. The revolver handgun of claim 4 wherein said trigger mechanism additionally includes a means to move said cylinder forward immediately before firing said gun to effectively seal said cylinder against expulsion of gases produced by firing.

8. A revolver handgun having a barrel section and a handle section, said barrel section including a reciprocally movable trigger and a totally enclosed cylinder rotatable in a cylindrical recess in said barrel section, said barrel section and said handle section releasably lockable to each other and pivotably openable to make said cylinder slidably removable from said recess, said cylinder having on its outside surface a network of grooves to mate with a linearly reciprocable protrusion on said trigger whereby linear movement of said protrusion causes rotational movement of said cylinder, said network of grooves providing a pathway of repeating cam sections corresponding to the number of cartridge chambers in said cylinder, each cam section having a first location where said trigger is in its normal position of rest and a second location where said trigger is fully pulled to its firing position with a cartridge chamber of said cylinder aligned with the barrel; said protrusion being retractably spring biased and said network of grooves including a short discontinuity in said grooves between said first location and said second location.

* * * * *